US008192300B2

(12) United States Patent
Wada et al.

(10) Patent No.: US 8,192,300 B2
(45) Date of Patent: Jun. 5, 2012

(54) GOLF CLUB HEAD

(75) Inventors: Kozue Wada, Chichibu (JP); Wataru Ban, Chichibu (JP); Hiroshi Takahashi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 224 days.

(21) Appl. No.: 12/533,115

(22) Filed: Jul. 31, 2009

(65) Prior Publication Data

US 2010/0160074 A1 Jun. 24, 2010

(30) Foreign Application Priority Data

Dec. 19, 2008 (JP) ..... 2008-323466

(51) Int. Cl.
*A63B 53/04* (2006.01)

(52) U.S. Cl. ..... 473/332; 473/345

(58) Field of Classification Search ..... 473/324–350
See application file for complete search history.

(56) References Cited

U.S. PATENT DOCUMENTS

| | | | | |
|---|---|---|---|---|
| 4,928,965 | A * | 5/1990 | Yamaguchi et al. | 473/332 |
| 5,316,298 | A * | 5/1994 | Hutin et al. | 473/332 |
| 5,586,947 | A * | 12/1996 | Hutin | 473/324 |
| 5,935,020 | A * | 8/1999 | Stites et al. | 473/345 |
| 6,325,728 | B1 * | 12/2001 | Helmstetter et al. | 473/328 |
| 6,475,102 | B2 * | 11/2002 | Helmstetter et al. | 473/344 |
| 6,743,119 | B2 * | 6/2004 | Lo | 473/346 |
| 6,932,718 | B2 | 8/2005 | Nishitani | |
| 7,128,662 | B2 * | 10/2006 | Kumamoto | 473/345 |
| 7,160,205 | B2 * | 1/2007 | Yamamoto | 473/345 |
| 7,273,419 | B2 * | 9/2007 | Evans et al. | 473/328 |
| 7,390,271 | B2 * | 6/2008 | Yamamoto | 473/345 |
| 7,393,287 | B2 * | 7/2008 | Huang | 473/329 |
| 7,445,564 | B2 * | 11/2008 | Kusumoto | 473/346 |
| 7,537,527 | B2 * | 5/2009 | Yamamoto | 473/324 |
| 7,637,823 | B2 * | 12/2009 | Shimazaki et al. | 473/332 |
| 7,686,707 | B2 * | 3/2010 | Matsunaga et al. | 473/332 |
| 7,934,998 | B2 * | 5/2011 | Yokota | 473/227 |
| 2007/0149313 | A1 | 6/2007 | Matsunaga et al. | |
| 2007/0149314 | A1 | 6/2007 | Ban | |

FOREIGN PATENT DOCUMENTS

| | | | |
|---|---|---|---|
| JP | 2003-339922 | A | 12/2003 |
| JP | 2004-049559 | A | 2/2004 |
| JP | 2004-049733 | A | 2/2004 |
| JP | 2006-204604 | A | 8/2006 |
| JP | 2007-175079 | A | 7/2007 |
| JP | 2007-175325 | A | 7/2007 |
| JP | 2008-200319 | A | 9/2008 |
| JP | 2008-200339 | A | 9/2008 |

* cited by examiner

*Primary Examiner* — Alvin Hunter
(74) *Attorney, Agent, or Firm* — Sughrue Mion, PLLC

(57) ABSTRACT

A golf club head having a hollow construction produces a characteristic low ball hitting sound to accommodate the diversity of golfers' preferences for ball hitting sounds even if the volume of the golf club head is increased to 430 to 500 cc and the weight thereof is decreased to 160 to 220 g. In a golf club head having a hollow construction and including a face part, a sole part, a crown part, and a side part, in which the head volume is 430 to 500 cc, and the head weight is 160 to 220 g, the area of the sole part is increased so that the primary natural frequency of the sole part is 2400 Hz or less, and a weight is formed at a position of the center of vibration in the sole part on the inner surface on the hollow construction side of the sole part.

7 Claims, 5 Drawing Sheets

GOLF CLUB HEAD

BACKGROUND OF THE INVENTION

The present invention relates to a golf club head having a hollow construction.

Recently, large golf club heads having a head volume exceeding 430 cc have been developed. Since the large head has an enlarged sweet area on the head, it has become possible to manufacture an easy-to-use golf club that is less likely to cause a decrease in carry even in an off-center shot. However, if a head having a hollow construction is made large, the thicknesses of members forming a crown part and a sole part must be decreased. Therefore, a ball hitting sound at the time a ball hits tends to be low.

Generally, a high ball hitting sound peculiar to a metal head is to the golfer's liking. Therefore, various ways and means have been devised to control the ball hitting sound of such a large-size and light-weight head. For example, Japanese Patent Application Publication No. 2003-339922 describes a technique in which, to produce a high and clear ball hitting sound, a metallic thin small piece is fixed on the inner surface of a golf club head on the toe side of a sole part in a state in which one plate surface of the small piece adheres closely to the sole part. Also, Japanese Patent Application Publication No. 2006-204604 describes a technique in which, to improve the low ball hitting sound, at least one rib extending from the toe side to the heel side is arranged in the sole part, and this rib is extended curvedly so that the toe-side end and the heel-side end of the rib are nearer to the face side than the central area of the rib.

On the other hand, not all golfers like a metallic and high-pitched sound. Japanese Patent Application Publication No. 2008-200319 and Japanese Patent Application Publication No. 2008-200339 describe a technique in which, to make the ball hitting sound of golf club head loud and to make the reverberation long, the radius of curvature of the sole part, crown part, or side part is made larger than the minimum radius of curvature of the face surface of golf club head, and a rib or a flat plate shaped member is provided in a portion having a larger radius of curvature so that the value of resonance frequency of this portion is within ±10% of the value of resonance frequency of the face surface.

SUMMARY OF THE INVENTION

An object of the present invention is to provide a golf club head having a hollow construction, which produces a characteristic low ball hitting sound to accommodate the diversity of golfers' preferences for ball hitting sounds even if the volume of the golf club head is increased to 430 to 500 cc and the weight thereof is decreased to 160 to 220 g.

To achieve the above object, as one aspect of the present invention, a golf club head in accordance with the present invention has a hollow construction, includes a face part, a sole part, a crown part, and a side part, and is characterized in that the head has a volume in the range of 430 to 500 cc and a weight in the range of 160 to 220 g; and the area of the sole part is in the range such that the primary natural frequency of the sole part is 2400 Hz or lower.

As another aspect of the present invention, a golf club head in accordance with the present invention has a hollow construction, including a face part, a sole part, a crown part, and a side part, and is characterized in that the head has a volume in the range of 430 to 500 cc and a weight in the range of 160 to 220 g; and a weight is formed on the inner surface of the sole part so that the primary natural frequency of the sole part is 2400 Hz or lower.

As still another aspect of the present invention, a golf club head in accordance with the present invention has a hollow construction, including a face part, a sole part, a crown part, and a side part, and is characterized in that the head has a volume in the range of 430 to 500 cc and a weight in the range of 160 to 220 g; and the radius of curvature of the outer surface of the sole part in the toe-to-heel direction is 230 mm or larger so that the primary natural frequency of the sole part is 2400 Hz or lower.

In the above-described second and third aspects, the area of the sole part is preferably in the range of 3000 to 14,000 $mm^2$. Also, in the first and third aspects, a weight is preferably formed in a portion of the center of vibration in the sole part on the inner surface of the sole part. Furthermore, in the first and second aspects, the radius of curvature of the outer surface of the sole part in the toe-to-heel direction is 230 mm or greater.

As described above, according to the present invention, even for a large-size and light-weight golf club head having a volume of 430 to 500 cc and a weight of 160 to 220 g, the primary natural frequency of the sole part can be made 2400 Hz or lower by increasing the area of the sole part, by forming a weight on the inner surface on the hollow construction side of the sole part, or by making the radius of curvature of the outer surface of the sole part in the toe-to-heel direction 230 mm or larger. Thereby, a characteristic low ball hitting sound can be obtained.

DESCRIPTION OF THE PREFERRED EMBODIMENTS

Figure 1A:
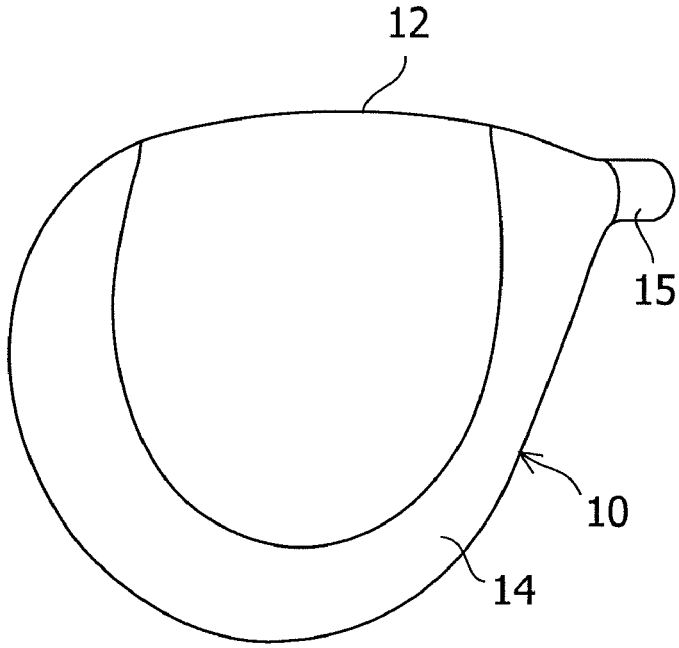
FIG. 1A is a bottom plan view showing a first embodiment of a golf club head in accordance with the present invention.

Embodiments of a golf club head in accordance with the present invention will now be described with reference to the accompanying drawings. FIG. 1A is a bottom plan view showing a first embodiment of the golf club head in accordance with the present invention, and FIG. 1B is a front view of the golf club head shown in FIG. 1A.

Figure 1B:
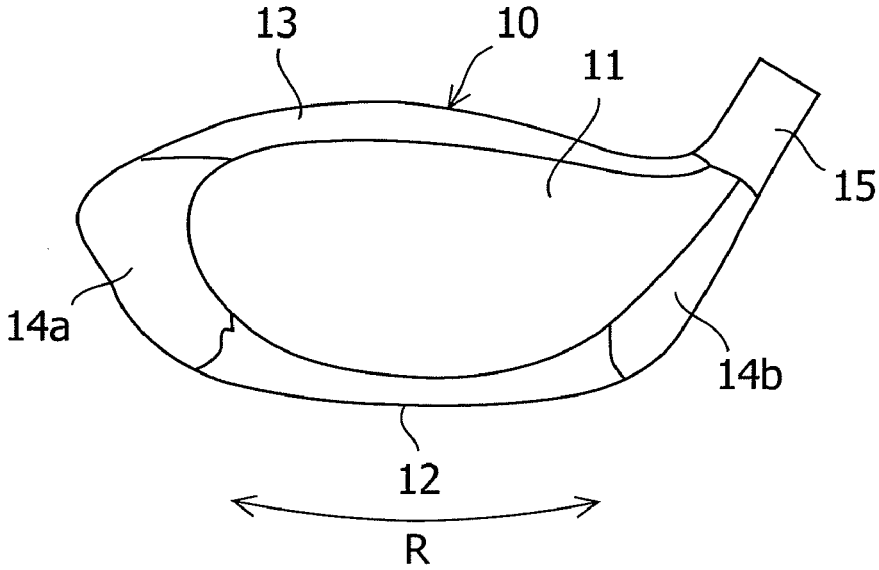
FIG. 1B is a front view of the golf club head shown in FIG. 1A.

As shown in FIGS. 1A and 1B, a golf club head 10 of this embodiment includes a face part 11, a sole part 12, a crown part 13, a side part 14, and a hosel part 15. The side part 14 wraps around the head 10 from the toe side 14*a* to the heal side 14*b* via the back side. Also, the face part 11 and the sole part 12 are formed so as to be adjacent to each other. Although not shown in particular, the head 10 has a hollow construction, and the inner surfaces on the hollow construction side of the parts of head are formed so as to be almost smooth like the outer surface thereof.

In the present invention, a large golf club head having a volume of 430 cc or greater is taken up. A further preferred head volume is 435 cc or greater. On the other hand, the upper limit of the head volume is 500 cc, preferably 470 cc. Also, in the present invention, a lightweight golf club head having a weight of 220 g or less is taken up. A preferred club weight is 195 g or less. On the other hand, the lower limit of head weight is 160 g, preferably 165 g.

In this embodiment, the area of the sole part 12 is designed so as to be large so that the primary natural frequency of vibrations of the sole part 12 caused when a ball is hit by the golf club head 10 is 2400 Hz or less. For example, the area of the sole part 12 is preferably 4000 $mm^2$ or greater, more preferably 6000 $mm^2$ or greater. By remarkably increasing the area of the sole part 12 with respect to the head volume in this manner, the amplitude of the sole part 12 is increased, so that the primary natural frequency of the sole part 12 can be made 2400 Hz or less.

The primary natural frequency is preferably 2200 Hz or less, more preferably 2000 Hz or less. The lower limit of the primary natural frequency is preferably 1300 Hz because too large a head volume is not to a golfer's liking. On the other hand, if the area of the sole part 12 is too large, swing is hindered. Therefore, the area of the sole part 12 is preferably 14,000 $mm^2$ or less, more preferably 13,000 $mm^2$ or less.

The radius of curvature R of the outer surface of the sole part 12 in the direction directed from the toe side 14*a* to the heel side 14*b* is preferably 150 mm or greater, further preferably 160 mm or greater. On the other hand, if the radius of curvature R is too large, it is difficult for the golfer to set up the head 10, which poses a problem of difficulty in assuming a posture. Therefore, the radius of curvature R is preferably 500 mm or less, further preferably 450 mm or less.

To maintain a fixed strength, the wall thickness of the sole part 12 is preferably 0.6 mm or greater, further preferably 0.7 mm or greater. On the other hand, if the wall thickness is too large, the weight increases. Therefore, the wall thickness of the sole part 12 is preferably 1.5 mm or less, further preferably 1.2 mm or less.

In this specification, the "sole part" means a part having a wall thickness different from that of the adjacent side part or face part. In the case in which the wall thickness of the sole part is the same as that of the side part or the face part, a portion in which the radius of curvature R of the outer surface of the sole part changes greatly is made a boundary with the side part or the face part. Also, the "area of the sole part" means an area of the outer surface of the sole part.

Figure 2A:
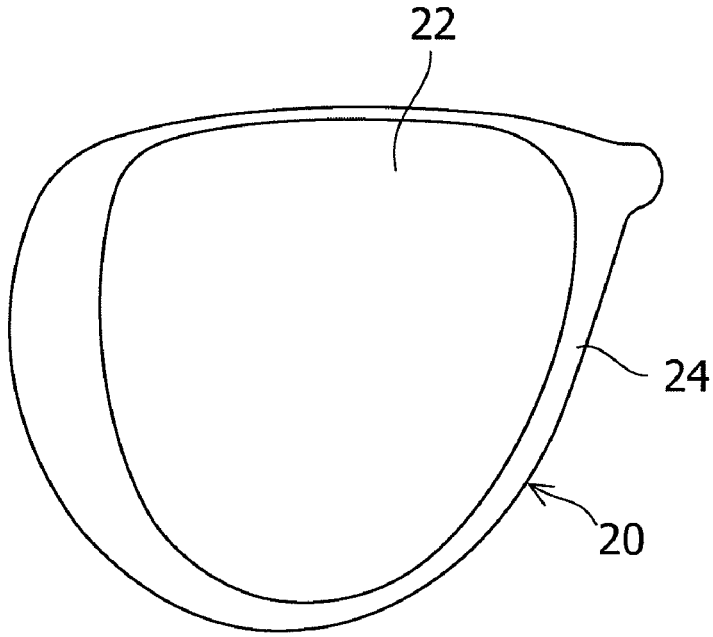
FIG. 2A is a bottom plan view showing a second embodiment of a golf club head in accordance with the present invention.
Figure 2B:
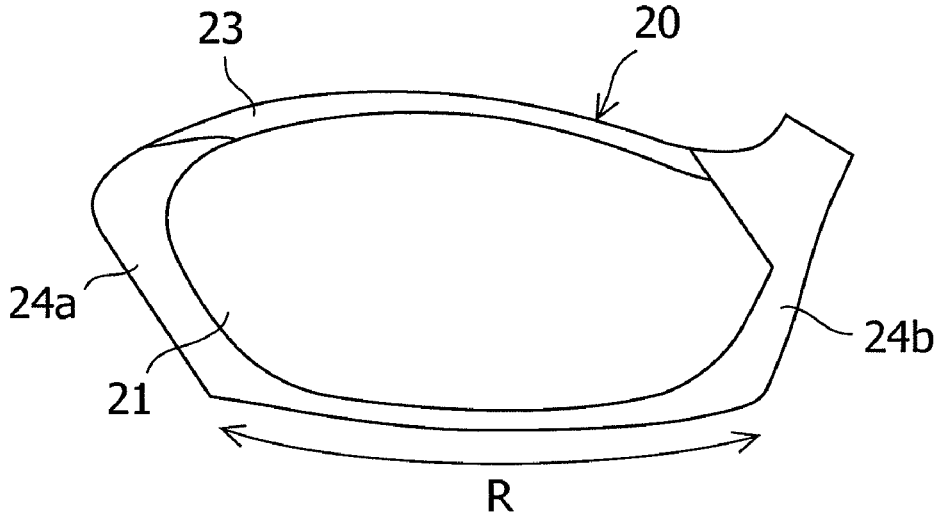
FIG. 2B is a front view of the golf club head shown in FIG. 2A.

FIGS. 2A and 2B show a second embodiment of the golf club head in accordance with the present invention, FIG. 2A being a bottom plan view of the golf club head, and FIG. 2B being a front view thereof. As shown in FIGS. 2A and 2B, a golf club head 20 of this embodiment also includes a face part 21, a sole part 22, a crown part 23, a side part 24, and a hosel part 25. In this embodiment, the side part 24 is formed between the face part 21 and the sole part 22.

In this embodiment, the radius of curvature R of the outer surface of the sole part 22 in the direction directed from the toe side 24*a* to the heel side 24*b* is designed so as to be large, being 230 mm or greater, so that the primary natural frequency of the sole part 22 is 2400 Hz or less. This radius of curvature R is preferably 350 mm or greater, further preferably 400 mm or greater. By remarkably increasing the radius of curvature R of the sole part 22 in this manner, the shape of the sole part 22 is made flat, so that the primary natural frequency of the sole part 22 can be made 2400 Hz or less. On the other hand, if the radius of curvature R is too large, the above-described problem arises. Therefore, the radius of curvature R is preferably 500 mm or less, further preferably 450 mm or less.

In this embodiment, the area of the sole part 22 need not necessarily be increased, and is preferably 3000 $mm^2$ or greater, more preferably 4000 $mm^2$ or greater, and still more preferably 6000 $mm^2$ or greater. To maintain a fixed strength, the wall thickness of the sole part 22 is preferably 0.6 mm or greater, more preferably 0.7 mm or greater. On the other, if the wall thickness of the sole part 22 is too large, the weight increases. Therefore, the wall thickness of the sole part 22 is preferably 1.5 mm or less, further preferably 1.2 mm or less.

Figure 3A:
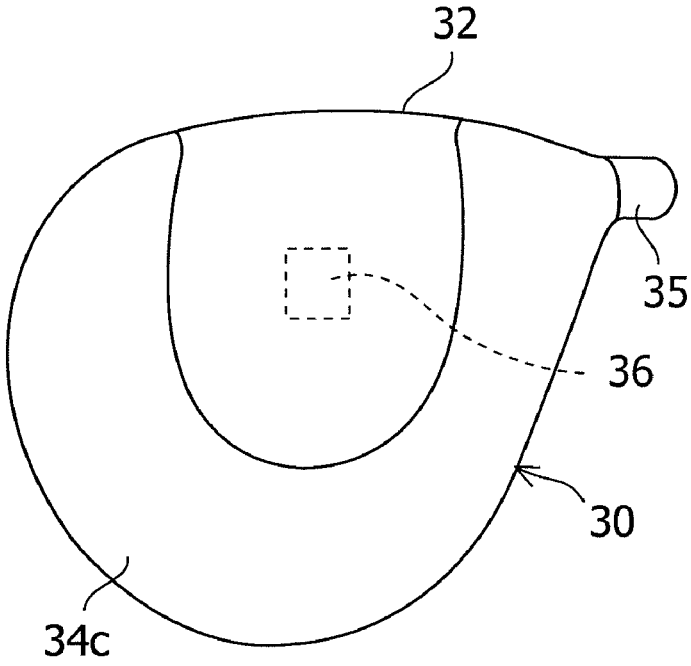
FIG. 3A is a bottom plan view showing a third embodiment of a golf club head in accordance with the present invention.
Figure 3B:
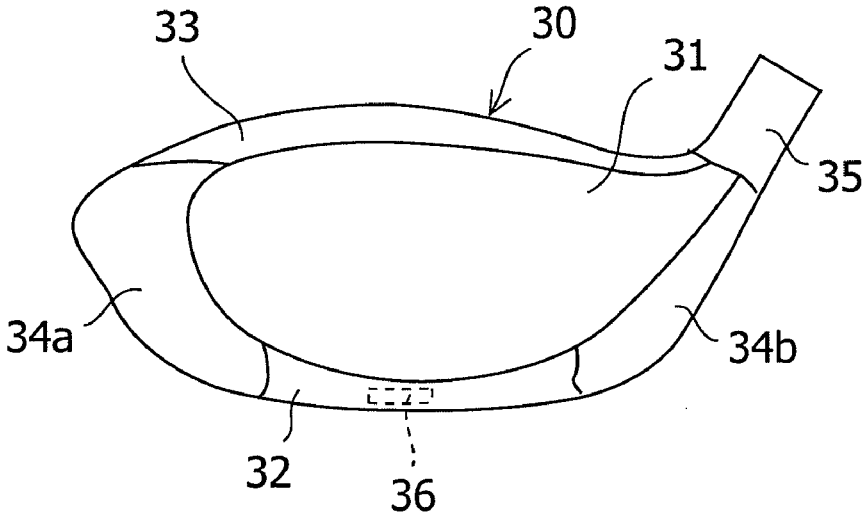
FIG. 3B is a front view of the golf club head shown in FIG. 3A.

FIGS. 3A and 3B show a third embodiment of the golf club head in accordance with the present invention, FIG. 3A being a bottom plan view of the golf club head, and FIG. 3B being a front view thereof. As shown in FIGS. 3A and 3B, a golf club head 30 of this embodiment also includes a face part 31, a sole part 32, a crown part 33, a side part 34, and a hosel part 35.

In this embodiment, a weight 36 is formed on the inner surface on the hollow construction side of the sole part 32 so that the primary natural frequency of the sole part 32 is 2400 Hz or less. Since the weight 36 is formed within the head 30, the weight 36 is shown by a broken line in FIGS. 3A and 3B. The weight 36 is preferably formed at a position of the center of vibration caused in the sole part 32 at the time of hitting a ball. By forming the weight 36 at the position of the center of vibration in this manner, the primary natural frequency of the sole part 32 can be decreased to 2400 Hz or less. The center of vibration of the sole part 32 usually takes place at a position of the centroid of the sole part 32 if the wall thickness of the sole part 32 is uniform.

The weight of the weight 36 is preferably 3 g or greater, further preferably 4 g or greater. If the weight is too large, an influence is exerted on swing balance, or the whole of head becomes heavy, so that there arises a problem in that the head volume must be decreased. Therefore, the weight of the weight 36 is preferably 10 g or less, further preferably 9 g or less. Also, to control the vibrations of the sole part 32 properly, the area of the weight 36 that is in contact with the inner surface of the sole part 32 is preferably 200 $mm^2$ or less, further preferably 150 $mm^2$ or less. The lower limit of this area is preferably 20 $mm^2$.

FIGS. 3A and 3B show the case in which the shape of the weight 36 is a rectangular prism. However, the shape of the weight 36 is not limited to this, and a rectangular prismatic, spherical, ellipsoidal, cylindrical, conical, or truncated conical shape, or other polyhedral shapes may be used. Also, the weight 36 may be joined to the sole part 32, for example, by welding by adhering one surface thereof closely to the inner surface of the sole part 32, or may be formed integrally, for example, by casting.

In this embodiment as well, as in the second embodiment, the area of the sole part 32 need not necessarily be increased, and is preferably 3000 $mm^2$ or greater, more preferably 4000 $mm^2$ or greater, and still more preferably 6000 $mm^2$ or greater. The wall thickness of the sole part 32 is preferably 0.6 mm or greater, more preferably 0.7 mm or greater as in the second embodiment. Also, the wall thickness of the sole part 32 is preferably 1.5 mm or less, more preferably 1.2 mm or less.

Figure 4A:
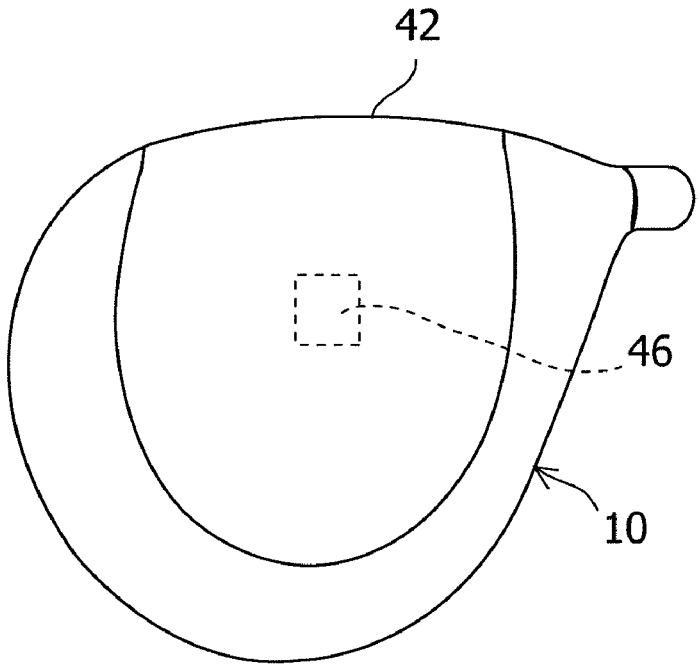
FIG. 4A is a bottom plan view showing a fourth embodiment of a golf club head in accordance with the present invention.
Figure 4B:
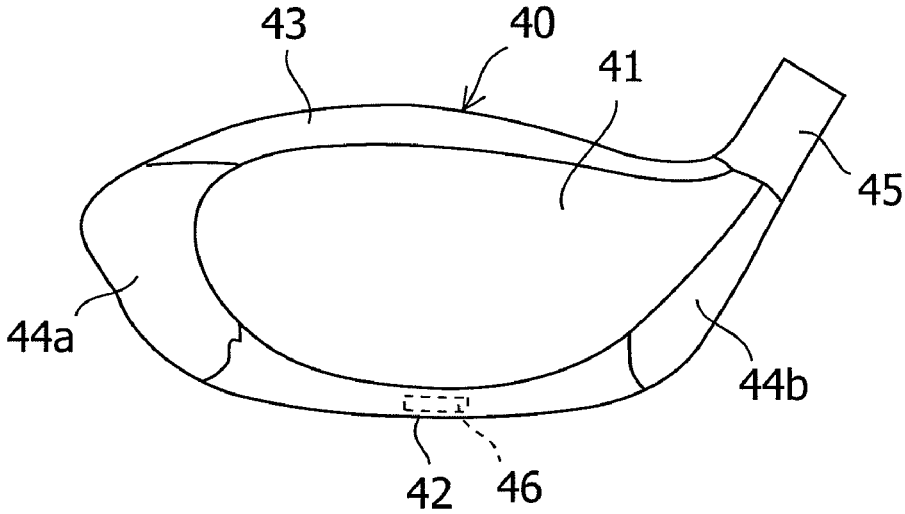
FIG. 4B is a front view of the golf club head shown in FIG. 4A.

FIGS. 4A and 4B show a fourth embodiment of the golf club head in accordance with the present invention, FIG. 4A being a bottom plan view of the golf club head, and FIG. 4B being a front view thereof. As shown in FIGS. 4A and 4B, this embodiment is a combination of the first embodiment and the third embodiment. That is to say, the area of a sole part 42 is designed so as to be large, and a weight 46 is formed on the inner surface of the sole part 42.

In this embodiment, the area of the sole part 42 is preferably 4000 $mm^2$ or greater, further preferably 6000 $mm^2$ or greater. By making the area of the sole part 42 large and by forming the weight 46 on the inner surface of the sole part 42 as described above, the primary natural frequency of the sole part 42 can be made 2200 Hz or less, further 2000 Hz or less. The upper limit of the area is preferably 14,000 $mm^2$, more preferably 13,000 $mm^2$. The weight 46 is preferably formed at a position at the center of vibration of the sole part 42. Although FIGS. 4A and 4B show one weight 46, since the area of the sole part 42 is large, a plurality of weights 46 can be formed when the center of vibration takes place at a plurality of positions of the sole part 42.

As described above, in the present invention, the first through third embodiments can be combined. The area and the radius of curvature of the sole part are increased by combining the first and second embodiments, a weight is formed on the inner surface of the sole part having an increased radius of curvature by combining the second and third embodiments, or a weight is formed on the inner surface of the sole part having an increased area and an increased radius of curvature by combining the first through third embodiments. Thereby, the primary natural frequency of the sole part can be made 2200 Hz or less, or more preferably 2000 Hz or less.

In any of these embodiments, the face part, the sole part, the crown part, the side part, the hosel part, and the weight can be made of a metallic material having the same or different composition. These elements are preferably made of, for example, a titanium alloy or an aluminum alloy. For example, a titanium alloy (Ti-6Al-4V) having a composition of 5.5 to 6.75 wt % Al, 3.5 to 4.5 wt % V, the balance being Ti and unavoidable impurities can be used.

EXAMPLES

Golf club heads of examples 1 to 4 and a comparative example having specifications given in Table 1 were manufactured. The "length" in Table 1 means a distance between the toe and the heel of the sole part, and the "depth" in Table 1 means a distance between the face and the back of the sole part. The appearances of examples 1 to 4 and comparative example correspond to FIGS. 1A to 5B. In all of the examples and the comparative example, the Ti-6AL-4V alloy was used, and the head had a volume of 450 cc. The primary natural frequencies of the sole parts of the examples 1 to 4 and the comparative example were determined by FEM analysis. The results are given in Table 1.

TABLE 1

Figure 5A:
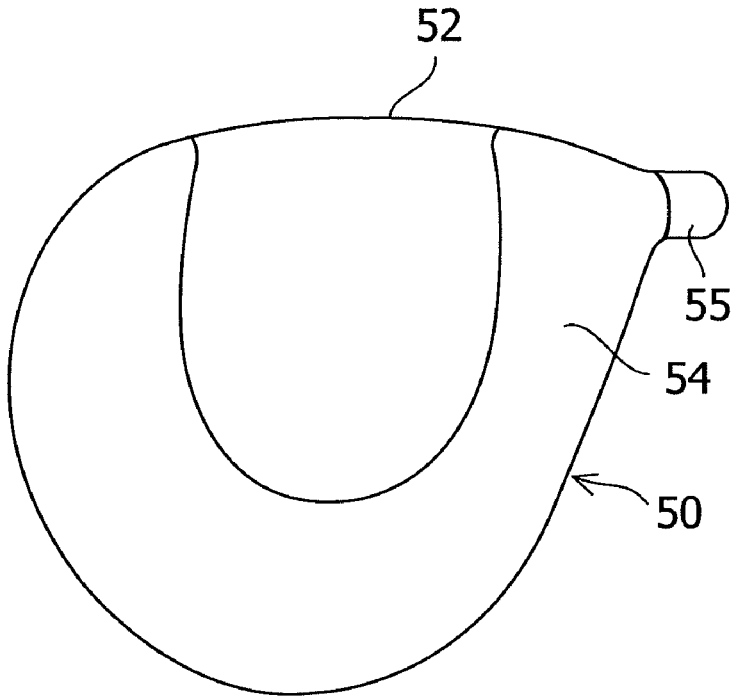
FIG. 5A is a bottom plan view of a golf club head of comparative example.
Figure 5B:
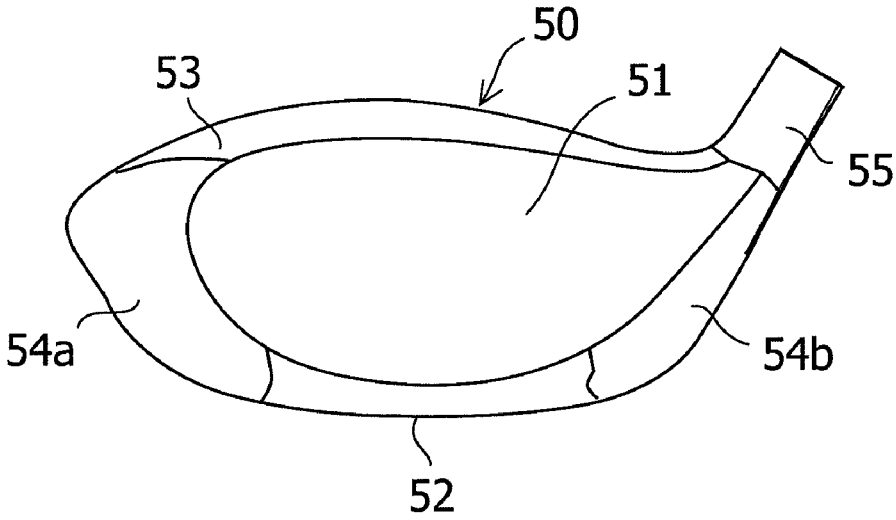
FIG. 5B is a front view of the golf club head shown in FIG. 5A.

| | | Sole | | | | | | | Primary |
|---|---|---|---|---|---|---|---|---|---|
| | Appearance | Area [$mm^2$] | R [mm] | Wall thickness [mm] | Length [mm] | Depth [mm] | Weight [g] | Head weight [g] | natural frequency [Hz] |
| Example 1 | FIGS. 1A and 1B | 7113 | 234 | 0.8 | 119 | 94 | — | 180 | 2150 |
| Example 2 | FIGS. 2A and 2B | 7090 | 425 | 1.0 | 91 | 93 | — | 182 | 1919 |
| Example 3 | FIGS. 3A and 3B | 4466 | 165 | 0.8 | 63 | 76 | 5 | 183 | 2112 |
| Example 4 | FIGS.4A and 4B | 7113 | 234 | 0.8 | 119 | 94 | 5 | 182 | 1830 |
| Comparative Example | FIGS. 5A and 5B | 4466 | 165 | 0.8 | 63 | 76 | — | 175 | 2686 |

As shown in Table 1, for the comparative example having a sole area of about 4500 $mm^2$, the primary natural frequency of sole part was very high, being about 2700 Hz. On the other hand, for example 1 having a large sole area of about 7100 $mm^2$, the primary natural frequency of the sole part was able to be decreased significantly to about 2200 Hz. Also, for example 2 having a large sole area of about 7100 $mm^2$ and a large radius of curvature of sole of about 400 mm, the primary natural frequency of sole part was able to be decreased to about 1900 Hz. For example 3 having the same sole area as that of the comparative example and provided with a 5-gram weight in the center of vibration of sole part, the primary natural frequency of sole part was able to be decreased significantly to about 2100 Hz. Furthermore, for example 4 having a large sole area of about 7100 $mm^2$ and provided with a 5-gram weight in the center of vibration of sole part, the primary natural frequency of sole part was able to be decreased to about 1800 Hz.

What is claimed is:

1. A golf club head having a hollow construction, the head having a volume in the range of 430 to 500 cubic centimeters and a weight in the range of 160 to 220 grams, comprising:

a face part;

a sole part; the area of the sole part being in a range such that the primary natural frequency of the sole part is not higher than 2400 hertz, a crown part; and a side part, wherein the sole part has an area of at least 4000 $mm^2$ and has a radius of curvature of the outer surface thereof in a direction from a toe side to a heel side of at least 150 mm.

2. The golf club head according to claim 1, wherein a weight is formed in a portion of the center of vibration in the sole part on the inner surface of the sole part.

3. A golf club head having a hollow construction, the head having a volume in the range of 430 to 500 cubic centimeters and a weight in the range of 160 to 220 grams, comprising:

a face part;

a sole part, a crown part, a side part; and a weight formed on the inner surface of the sole part so that the primary natural frequency of the sole part is not higher than 2400 hertz, wherein the weight has a weight in the range of 3 to 10 grams.

4. The golf club head according to claim 3, wherein the area of the sole part is in the range of 3000 to 14,000 square millimeters.

5. A golf club head having a hollow construction, the head having a volume in the range of 430 to 500 cubic centimeters and a weight in the range of 160 to 220 grams, comprising:

a face part;

a sole part; the area of the sole part being in a range such that the primary natural frequency of the sole part is not higher than 2400 hertz, a crown part; and a side part, wherein the sole part has an area of at least 3000 $mm^2$ and has a radius of curvature of the outer surface thereof in a direction from a toe side to a heel side of at least 230 mm.

6. A golf club head having a hollow construction, the head having a volume in the range of 430 to 500 cubic centimeters and a weight in the range of 160 to 220 grams, comprising:

a face part;

a sole part, a crown part, a side part; and a weight formed on the inner surface of the sole part so that the primary natural frequency of the sole part is not higher than 2400 hertz, wherein the sole part has an area of at least 4000 $mm^2$ and has a radius of curvature of the outer surface thereof in a direction from a toe side to a heel side of at least 150 mm.

7. A golf club head having a hollow construction, the head having a volume in the range of 430 to 500 cubic centimeters and a weight in the range of 160 to 220 grams, comprising:

a face part;

a sole part, a crown part, a side part; and a weight formed on the inner surface of the sole part so that the primary natural frequency of the sole part is not higher than 2400 hertz, wherein the sole part has an area of at least 3000 $mm^2$ and has a radius of curvature of the outer surface thereof in a direction from a toe side to a heel side of at least 230 mm.

* * * * *